US007311464B2

(12) United States Patent
Swartz

(10) Patent No.: US 7,311,464 B2
(45) Date of Patent: Dec. 25, 2007

(54) ILLUMINATED SNOWBOARD RAILWAY TRACK

(76) Inventor: Craig Swartz, 8686 E. Kettle Ave., Centennial, CO (US) 80112

( * ) Notice: Subject to any disclaimer, the term of this patent is extended or adjusted under 35 U.S.C. 154(b) by 0 days.

(21) Appl. No.: 11/400,656

(22) Filed: Apr. 7, 2006

(65) Prior Publication Data

US 2006/0174428 A1 Aug. 10, 2006

Related U.S. Application Data

(63) Continuation-in-part of application No. 10/288,918, filed on Nov. 6, 2002, now abandoned.

(51) Int. Cl.
*E01B 25/00* (2006.01)

(52) U.S. Cl. ..... 404/71; 362/145; 362/223; 256/1; 472/90

(58) Field of Classification Search ..... 362/146, 362/216, 217, 219, 222, 223, 145, 212; 256/1, 256/59, 64; 404/1, 71; 238/10 R, 10 E, 238/121; 472/88, 90; 280/809
See application file for complete search history.

(56) References Cited

U.S. PATENT DOCUMENTS

| | | | | | |
|---|---|---|---|---|---|
| 2,270,474 | A | | 1/1942 | Reicher | |
| 2,479,500 | A | | 8/1949 | Longberg | |
| 2,563,529 | A | * | 8/1951 | Hawkins | 256/21 |
| 3,057,991 | A | | 10/1962 | Grenadier | |
| 3,131,871 | A | | 5/1964 | Foulds | |
| 3,473,017 | A | | 10/1969 | Lim et al. | |
| 3,544,782 | A | | 12/1970 | Hahn | |
| 3,596,880 | A | * | 8/1971 | Greenberg | 256/65.1 |
| 3,910,562 | A | * | 10/1975 | Helterbrand | 256/69 |
| 3,918,686 | A | * | 11/1975 | Knott et al. | 256/21 |
| 4,161,769 | A | | 7/1979 | Elliott | |
| 4,367,517 | A | | 1/1983 | Balzer | |
| 4,800,470 | A | | 1/1989 | Hartsaw | |
| 4,989,782 | A | * | 2/1991 | McKie | 238/10 R |
| 5,200,240 | A | * | 4/1993 | Baker | 428/34.1 |
| 5,450,299 | A | | 9/1995 | Lepre | |
| 5,592,786 | A | | 1/1997 | Kamm | |
| 5,708,749 | A | | 1/1998 | Kacheria | |
| 5,718,412 | A | * | 2/1998 | Levanas | 256/59 |
| 5,779,228 | A | | 7/1998 | Hansen | |
| 5,788,224 | A | * | 8/1998 | Platt | 256/66 |
| 5,902,067 | A | | 5/1999 | Rushing | |
| 5,924,386 | A | | 7/1999 | Lewis | |
| 6,042,480 | A | | 3/2000 | Labelson | |
| 6,065,852 | A | | 5/2000 | Crumley | |
| 6,105,905 | A | | 8/2000 | Spence | |
| 6,190,085 | B1 | | 2/2001 | Johansson | |
| 6,425,676 | B1 | | 7/2002 | Lyons | |
| 7,007,978 | B1 | * | 3/2006 | Purdom | 280/809 |
| 2004/0022504 | A1 | | 2/2004 | Currie et al. | |
| 2004/0086333 | A1 | * | 5/2004 | Swartz | 404/1 |

* cited by examiner

*Primary Examiner*—Gary S. Hartmann
(74) *Attorney, Agent, or Firm*—John E. Reilly; Ellen Reilly; The Reilly Intellectual Property Law Firm, P.C.

(57) ABSTRACT

An internally illuminated snowboard track for recreational areas or parks which are operated at night is made up of a continuous elongated transparent rail which is supported a predetermined distance above the ground by a base support member, and a light source extends longitudinally and internally of the rail to project light outwardly therefrom. A base stabilizer beneath the support member can either be planted in the snow or anchored to the ground surface in the track system may be inclined, curved, straight or provided with one or more bends. A snowboard ramp may be constructed in the same basic manner to serve as a jump for snowboarders.

19 Claims, 5 Drawing Sheets

ILLUMINATED SNOWBOARD RAILWAY TRACK

CROSS-REFERENCE TO RELATED APPLICATION

This application is a continuation-in-part of patent application Ser. No. 10/288,918, filed 6 Nov. 2002 now abandoned for ILLUMINATED SNOWBOARD RAILWAY TRACK by Craig Swartz and incorporated by reference herein.

BACKGROUND

In one aspect, there is provided a novel and improved internally illuminated and elevated railway track for snowboarding and skiing.

Snowboard terrain parks which are operated at night are becoming increasingly popular. Presently, there is a need for a track system and for snowboard or ski jumps for such parks which can be internally illuminated and easily installed and operated with a minimum amount of maintenance and supervision.

Previously, portable skating rails have been devised for skateboards and in-line skates which are made up of a modular series of square or tubular rails that are joined together by connectors and are supported on the ground surface by spaced support columns, for example, as illustrated in U.S. Pat. No. 5,718,412 to R. Levanas. Other patents are of interest for disclosing lighting apparatus for handrails and other tubular structure including U.S. Pat. No. 6,190,085 to J. K. Johansson, U.S. Pat. No. 5,708,749 to N. P. Kacheria and U.S. Pat. No. 5,450,299 to D. Lepre. U.S. Pat. No. 6,042,480 to R. Labelson discloses a skateboard ramp. See also, U.S. Pat. No. 6,065,852 to H. E. Crumley, U.S. Pat. No. 5,779,228 to R. C. Hansen, U.S. Pat. No. 6,425,676 to M. G. Lyons and U.S. Pat. No. 3,473,017 to S. K. Lim et al. Nevertheless, I am not aware of any prior development of an internally illuminated and elevated rail or ramp having a cross-sectional configuration and surface designed for snowboarding, skiing or skateboarding. For example, the rails are also suitable for use in skateboard parks that are open at night, or indoors. Still further, there is an unmet need for a snowboard track which can be illuminated through its upper surface and provided with necessary reinforcing along the lateral edges of the track to prevent chipping or gouging as well as undue wear from the metal edges of the snowboards or skis.

SUMMARY

It is therefore an object to provide for a novel and improved snowboard track system having an internally illuminated and elevated rail for snowboarding and wherein the rail can be curved, inclined or straight or a combination of same and is readily conformable for use on different terrain. Further, to provide for a novel and improved internally illuminated and elevated railway track system having a continuous base or ground support which is extremely durable, simplified and easy to install for use on different terrain.

It is an additional object to provide for a novel and improved snowboard track with outboard reinforcing edges and which is internally illuminated and has a textured surface to provide the optimum coefficient of friction for snowboard jumping.

There has been devised an illuminated snowboard track comprising a continuous elongated transparent rail, base support members for supporting the rail above a ground surface, and light tubes extending longitudinally and internally of the rail for projecting light outwardly therefrom.

The base support means may be in the form of a substantially continuous upright support member and a lateral stabilizer beneath the support member including transverse ground support members spaced along the length of the support. The rail itself is transparent and includes a substantially flat textured riding surface for the snowboard along with outboard reinforcing edges. The illuminating means may take the form of elongated neon or fluorescent tubing with a low voltage power source. The track may be inclined, curved, straight or formed with one or more bends. Furthermore, the track system of the present invention lends itself well to utilization as a snowboard jump on different inclines or grades.

There has been outlined, rather broadly, the more important features in order that the detailed description thereof that follows may be better understood, and in order that the present contribution to the art may be better appreciated. There are, of course, additional features that will be described hereinafter and which will form the subject matter of the claims appended hereto. In this respect, before explaining at least one embodiment in detail, it is to be understood that the embodiments are not limited to the details of construction and to the arrangements of the components set forth in the following description and is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes recited. It is important, therefore, that the claims be regarded as including such equivalent constructions.

DETAILED DESCRIPTION OF ONE EMBODIMENT

Figure 1:
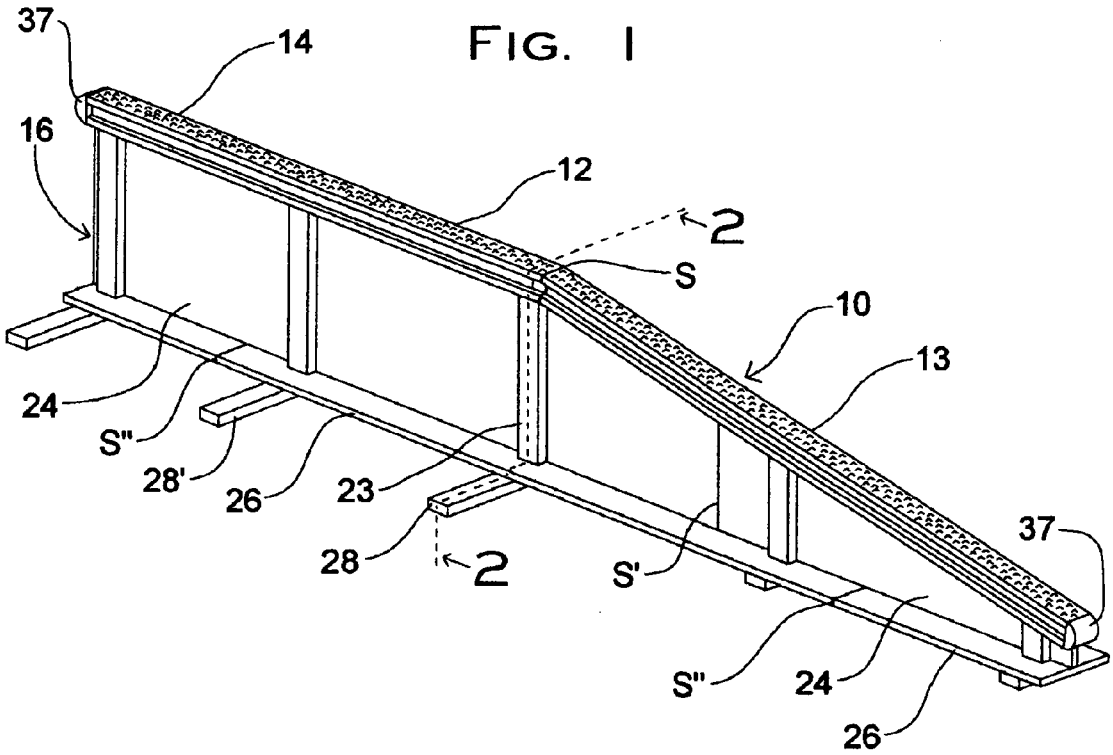
FIG. 1 is a perspective view of one embodiment of a track system.

Referring in detail to the drawings, there is shown in FIGS. 1 to 4 one embodiment of snowboard track system 10 comprising a transparent or translucent rail 12 including an inclined section 13 and level section 14 mounted on base support means generally designated at 16.

The rail 12 is preferably composed of a transparent or translucent material, such as, polycarbonate and of generally I-shaped cross-section with outboard metal reinforcing edges to be described. Thus, as best seen from FIG. 2, the rail has laterally spaced upright walls 18 extending between top and bottom horizontal flange surfaces 20 and 21, respectively, and at least the upper flange is adhered to the riding surface portion 22 and upper ends of the walls 18. Tubular reinforcing members 19 extend the full length of the track 20 and are joined by spaced center plates 19' along the length of the members 19 so that the top of each member 19 is level with the upper textured surface portion of the track. The plates 19' which join the edge members 19 are disposed in gaps 56 into the upper flange 20 beneath the upper riding surface 22; and similarly the tubular edge members 19 are partially embedded into slight depressions 22' in opposite sides of the flange 20. The top flange 20 with the upper textured riding surface 22 for the snowboard may be about 4" in width.

The base support means includes an upright continuous support panel 24 on the order of 2' to 8' high and spaced upright supports 23 mounted by suitable fasteners 25 on a base plate or lateral stabilizer 26; and the base plate 26 may be further stabilized by transverse support members 28 at spaced intervals along the length of the track system, and suitable fasteners 30 connect the base plate 26 to the cross members 28.

The walls 18 of the rail 12 define a central channel or cavity 32 into which is inserted the upper end 34 of the support panel 24 and is permanently fastened to the lower flange 21 by fasteners 36 at longitudinally spaced intervals along the rail.

Figure 2:
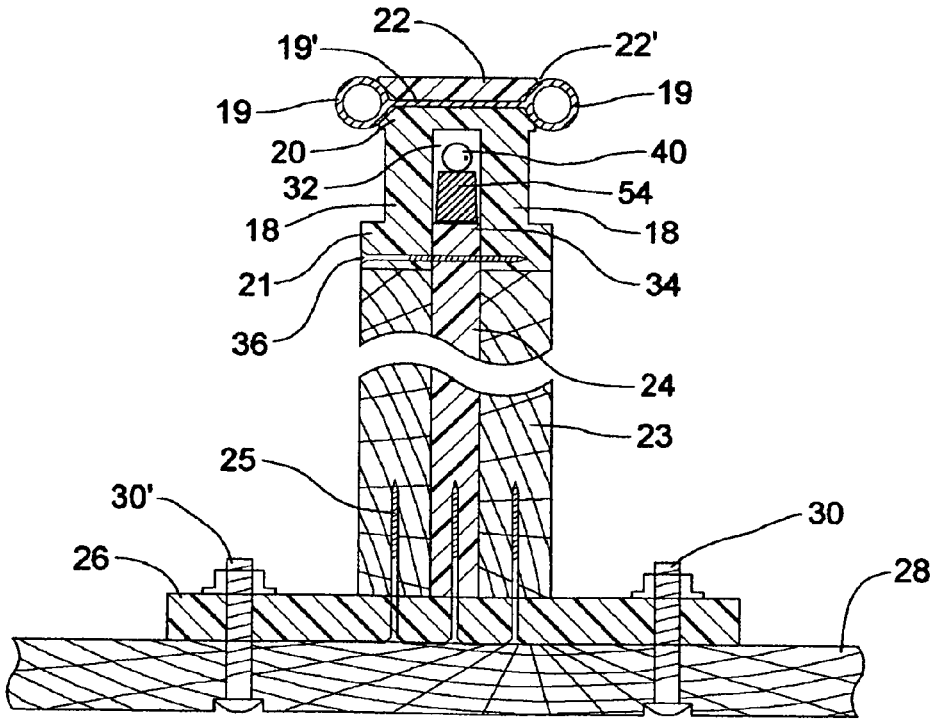
FIG. 2 is a cross-sectional view taken about lines 2-2 of FIG. 1.

The top surface of flange 20 of the rail 12 is textured as represented at 22 to produce the desired friction and may be textured in different ways depending on the composition of the surface and degree of incline. For example, plastic surfaces may be textured simply by roughening or by adhering a granular material to the surface. Blunt end covers in the form of bullnoses 37 are positioned at the leading and trailing ends of the rail, for example, as shown in FIG. 2. On the uphill end of the rail, the bullnose 37 acts as a deflector and prevents the snowboard from running directly into the leading edge; and on the downhill end minimizes injury to the snowboarder if he should fall backwards onto the end of the rail.

The track system 10 may be modular; i.e., formed in sections as indicated by the section lines S between the rails 13 and 14, S' between the upright supports 24 and S" between the base plates 26. Typically, in a snow terrain park, different grades are provided so that the track system should be contoured to match the existing landscape. Utilization of a broad base plate 26 which is approximately three times the width of the rail 12 achieves maximum lateral stability with minimum snow coverage. Additional lateral stability is achieved with the cross members 28.

Figure 3:
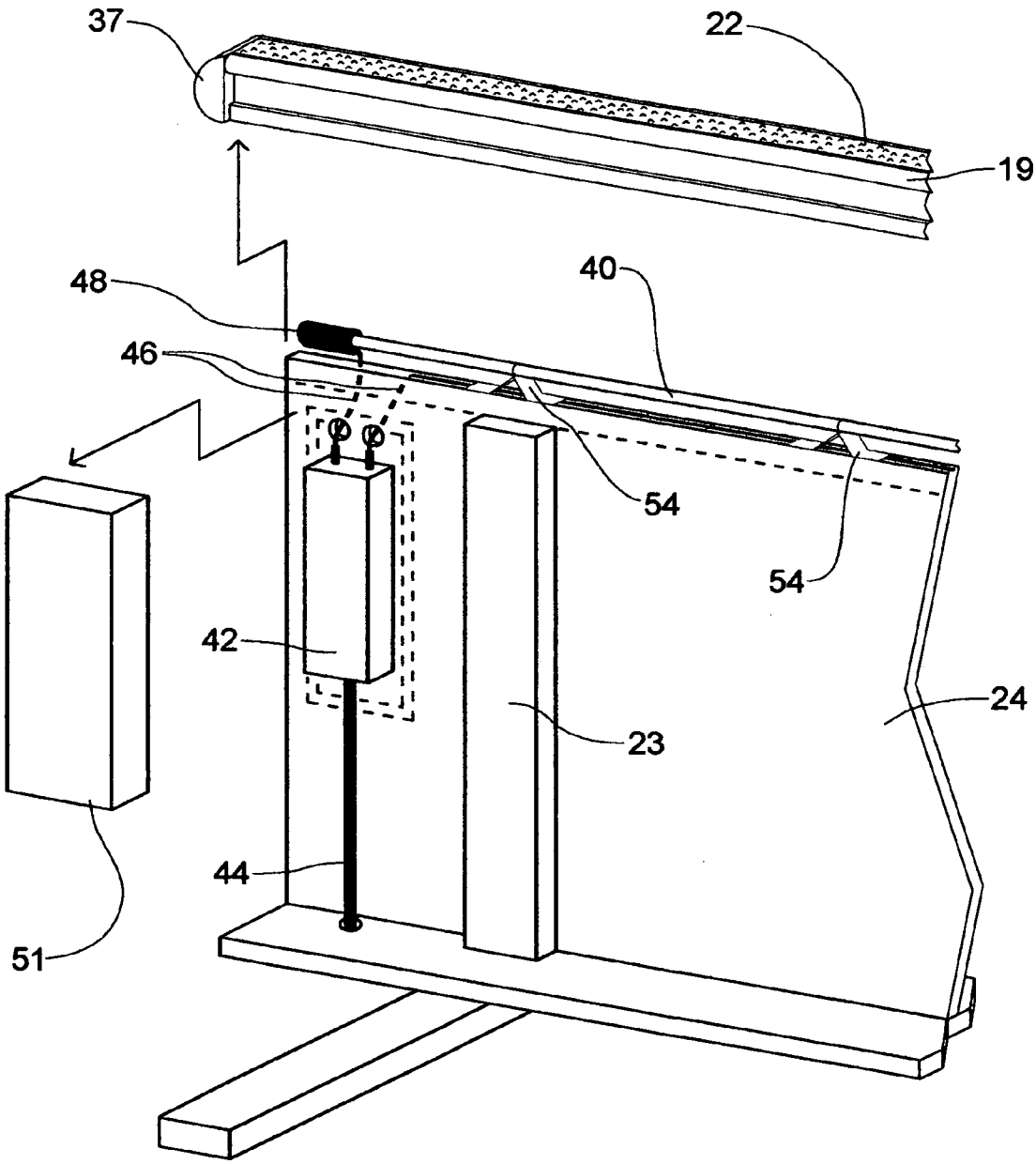
FIG. 3 is an exploded perspective view of one embodiment of snowboard track system.

One suitable form of lighting or illumination means is illustrated in FIGS. 2 and 3 and is a standard lighting system which employs neon tubing 40 which runs the length of the rail 12, there being a low-to-high voltage converter 42 illustrated in FIG. 3 connected to a power line 44 from a low voltage electrical power source, not shown. Special wire with H/V insulation as represented at 46 extends from the converter 42 to both ends of the tubing 40, and insulating caps 48 are mounted on the end of the tubing 40. The long return wire is enclosed by a cover or simply buried in the rail and connected to the converter. The converter and connection to incoming power cable also may be enclosed by a ½" thick plastic cover. The tubing 40 runs the length of the channel 32 and is supported at spaced intervals by suitable fasteners 54 extending upwardly from the upper end of the support member 24. In accordance with conventional practice, the power supply should have ground fault protection (GFCI) as used in bathroom outlets and otherwise should comply with UL requirements for neon signs. For the purpose of illustration but not limitation, a 10,000V power supply, 5.5 KV RMS will light about 50' of 15 mm. tubing. The light will project outwardly through the body of the rail and particularly through the upper flange 20 but will not be so intense as to produce a light glare to a snowboarder riding along the rail surface. Thus, the entire track or railway will be illuminated to guide the snowboarder in traversing the entire length of the railway. It will be evident that other standard light sources may be employed, such as, fluorescent tubing.

Figure 4:
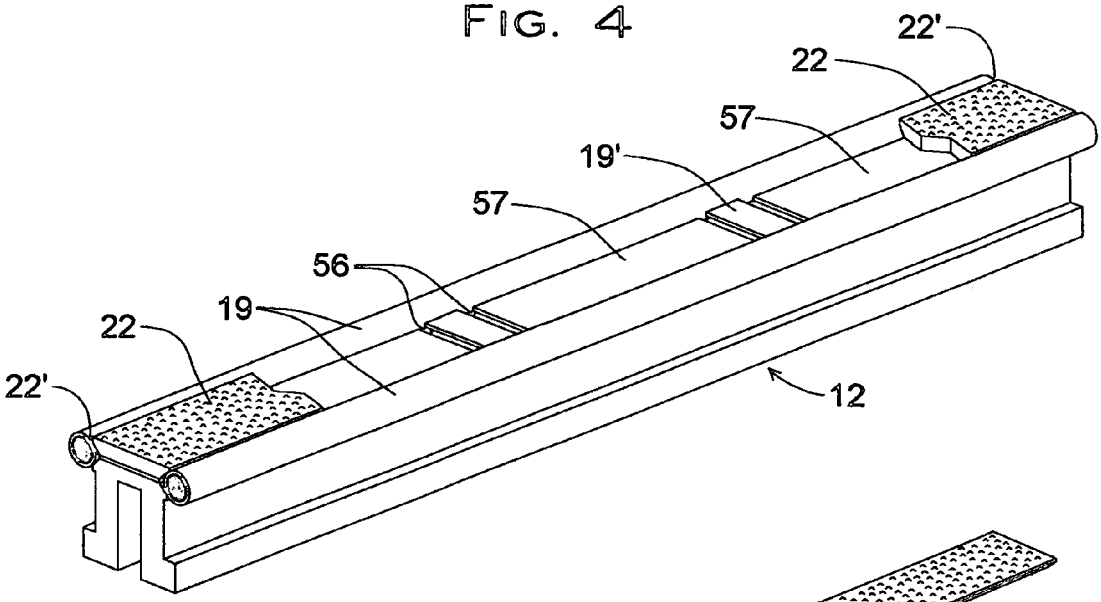
FIG. 4 is a somewhat fragmentary perspective view of a portion of the upper rail section of the track.
Figure 4A:
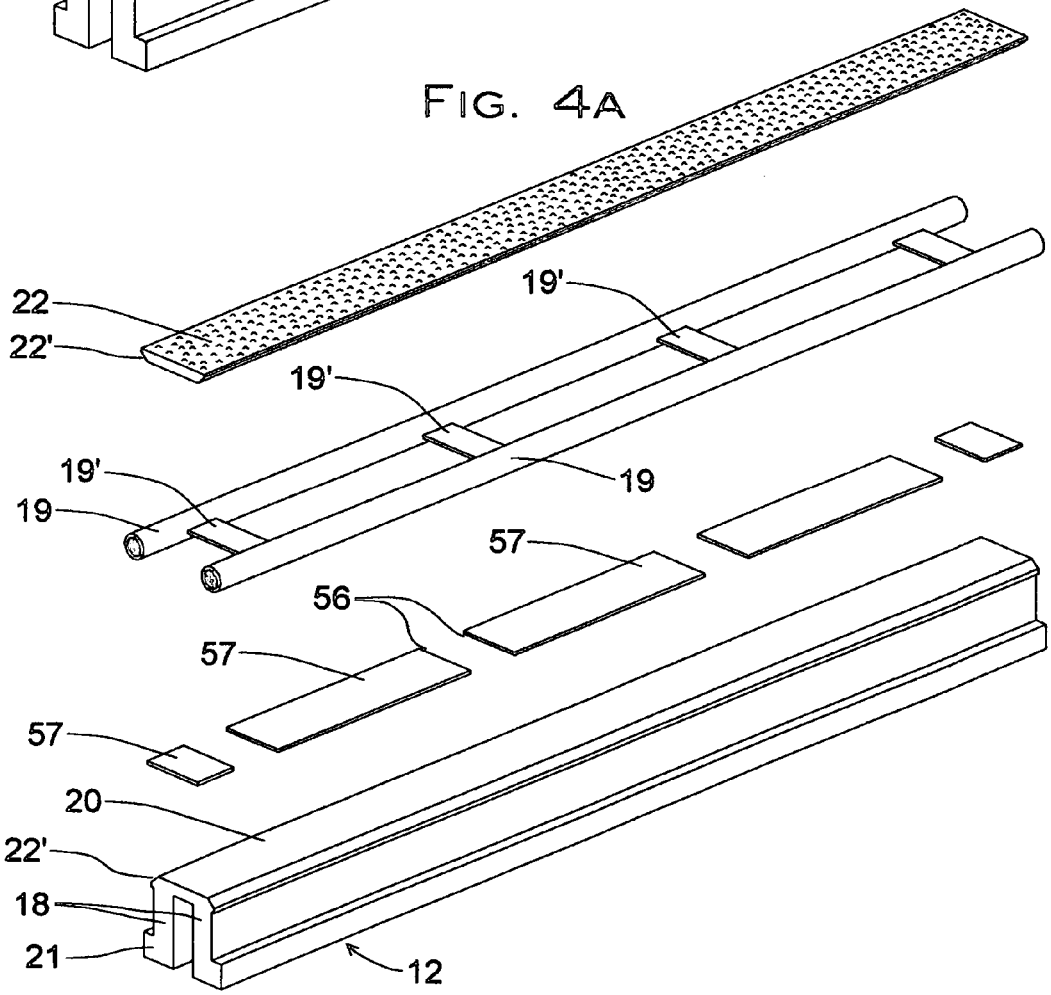
FIG. 4A is a somewhat fragmentary exploded view in perspective of a portion of the upper rail shown in FIG. 4.

FIG. 4 is an exploded view of the rail 12 in which the upper textured riding layer 22 is broken away to illustrate the top flange layer 20 which is provided with shallow gaps 56 at longitudinally spaced intervals along with the plates 19' positioned in the gaps 56. The gaps 56 compensate or allow for any expansion and contraction of the flange sections 20 in response to temperature changes as well as to permit slight shifting when exposed to high speed loading. It will be evident that the extent of snowboard loading will vary with the weight and speed of the individual skier or snowboarder. The layers 20, 57 and 22 are preferably glued together so as to securely hold the metal plates 19 in place without the use of screws and for this purpose are most desirably composed of a high strength plastic material, such as, one of the polycarbonates. The tubular outboard reinforcing members 19 are composed of any one of a number of high strength metals to reinforce the rail and are capable of withstanding or absorbing shock loading and impact or gouging by the metal edges of a snowboard or ski along the sides of the rail.

DETAILED DESCRIPTION OF SECOND EMBODIMENT

Figure 5:
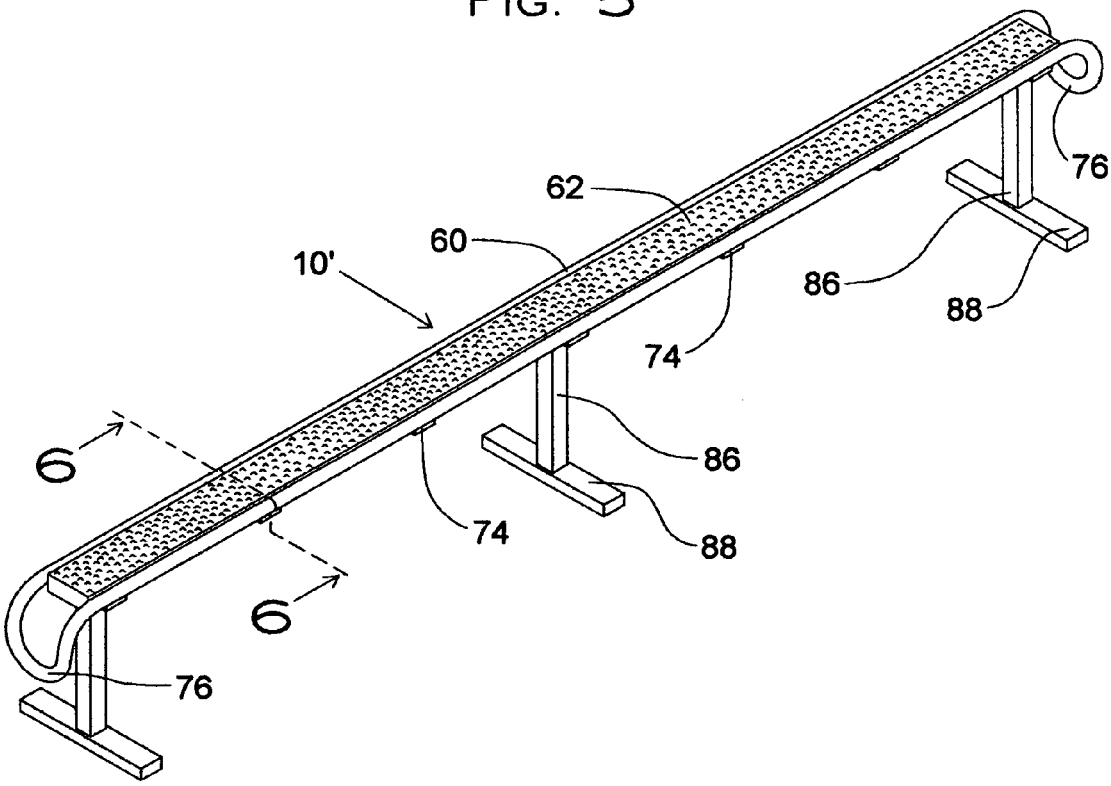
FIG. 5 illustrates a second embodiment of a snowboard track.
Figure 6:
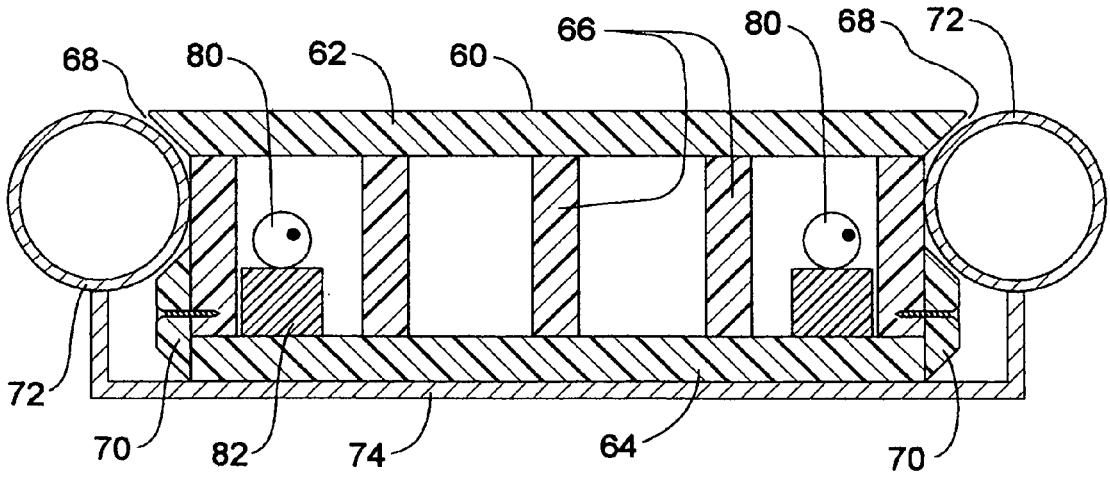
FIG. 6 is a cross-sectional view taken about lines 6-6 of FIG. 5.

There is shown in FIGS. 5 and 6 a modified form of track system 10' having an upper rail 60 of hollow generally rectangular configuration including an upper flat riding surface layer 62, a bottom layer 64 and horizontally spaced vertical support members 66 between the upper and lower flanges 62 and 64. At least the upper flange 62 is composed of a transparent or translucent material and has beveled edges 68 along opposite sides which together with lower, beveled side support members 70 form a pocket or depression therebetween for partial insertion of tubular reinforcing members 72. The reinforcing members 72 are joined together by a series of spaced brackets 74 which extend around the underside of the flange 64 at spaced intervals along the length of the rail; and opposite terminal ends of the tubular members 72 are curved downwardly and then joined together into a generally U-shaped configuration as designated at 76.

Another form of lighting system is illustrated in FIG. 6 which employs spaced neon tubing 80 in the cavities on opposite sides of the hollow rail and which are supported by suitable fasteners 82 corresponding to the fasteners 54 in FIGS. 1 to 4. Although not shown, the tubes 80 are connected to a power supply in the same manner as described with reference to FIG. 3. Placement of the tubing 80 in opposite corners of the rail is most effective with wider rails 60 on the order of 1' wide and will encourage the skier or snowboarder to follow a path between the members 72; and by forming the outer support posts 68 of translucent or transparent material will permit light to be transmitted along a broader area of the rail.

As further shown in FIG. 5, the rail system described is supported on a base support assembly made up of longitudinally spaced vertical support posts 86 and transverse base support members 88. The posts 86 may vary in length to control the grade or incline of the track system as hereinafter discussed in more detail in relation to FIG. 7.

The upper riding surface 22' of the rail 12' may be textured as shown to reduce the coefficient of friction on the surface.

Typically, the riding surface would not be sufficiently slippery without the texturing, causing the snowboarder to decelerate unexpectedly. It will further be evident that the grade or incline of the track system may be adjusted to form a ramp or jump which can be best utilized in areas having an existing snow pack so that a runway may be easily formed into the jump at the top of a hill, and a landing area may be suitably provided at the lower end of the jump.

Figure 7:
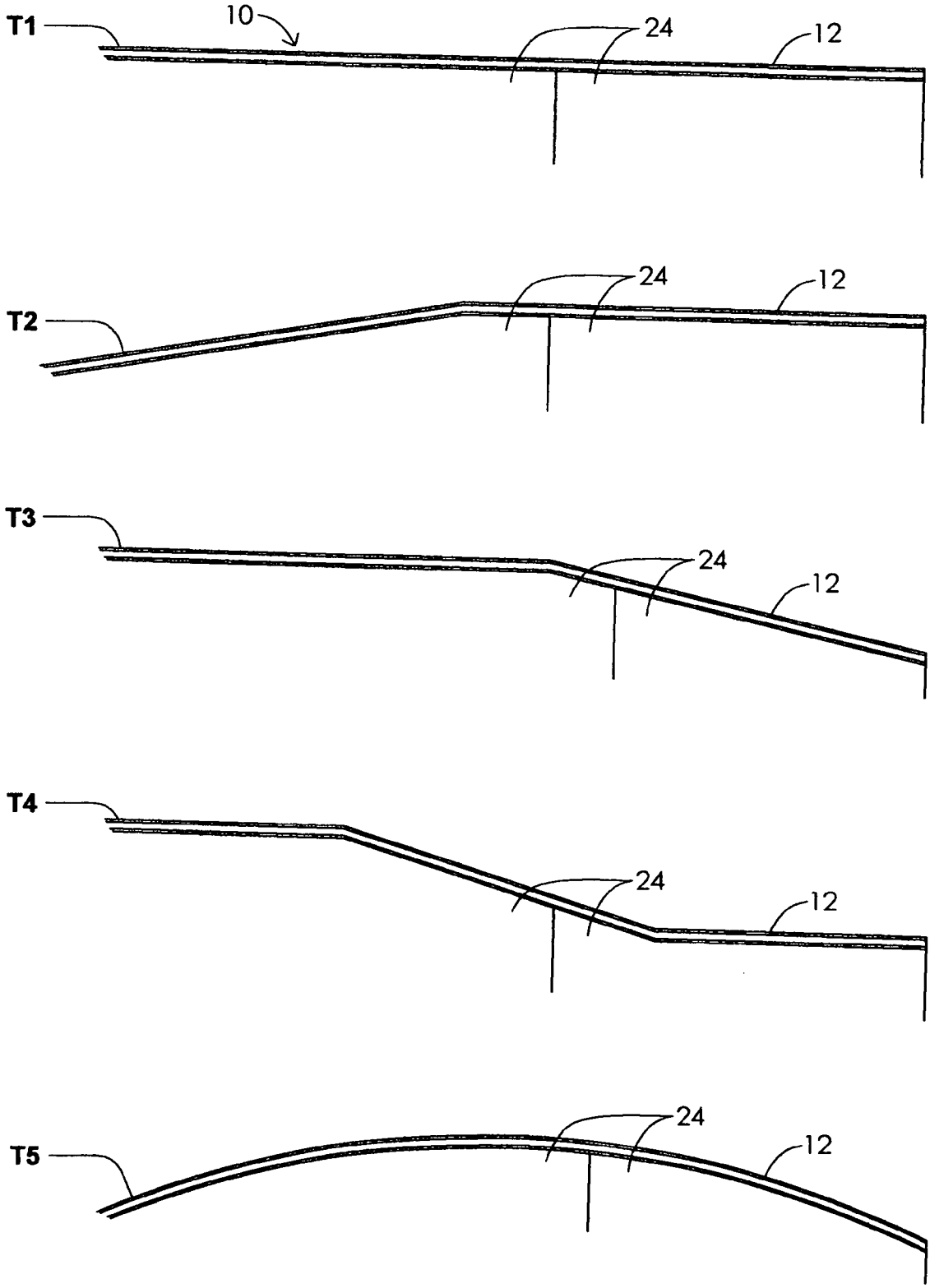
FIG. 7 illustrates various track configurations for the embodiments illustrated in FIGS. 1 to 6.

FIG. 7 schematically illustrates representative track layouts made up of the one embodiment of the track system 10 utilizing support members 24 corresponding to those utilized in FIGS. 1 to 4 but in different configurations to match the contour of the rail 12. Thus, a horizontal track system is illustrated at $T_1$, combination horizontal and inclined track system at $T_2$, $T_3$ and $T_4$, and a convex track system at $T_5$.

Any dimensions or angles given herein are for the purpose of illustration and not limitation. Similarly, the track system configurations of FIG. 7 are more for the purpose of illustration only; and the same is true of the types of internal lighting system disclosed in FIGS. 1 to 3, 5 and 6.

It is therefore to be understood that while different embodiments are herein set forth and described, the above and other modifications may be made in the composition of materials as well as construction and arrangement of parts without departing from the spirit and scope of the present invention as defined by the appended claims and reasonable equivalents thereof.

I claim:

1. An illuminated snowboard track comprising:

an elongated rail having an upper transparent, substantially flat, snowboard-engaging surface portion adapted for slidable advancement of a snowboard, skateboard or ski therealong, and elongated outboard reinforcing members extending continuously along opposite sides of said surface portion for the substantial length thereof;

means for supporting said rail above a ground surface; and means for projecting light upwardly through said transparent surface portion, said light-projecting means extending longitudinally through the interior of said rail.

2. An illuminated snowboard track according to claim 1 wherein said rail supporting means includes a substantially continuous, upright support member and a lateral stabilizer member.

3. An illuminated snowboard track according to claim 2 wherein said upright support member is in the form of a continuous panel.

4. An illuminated snowboard track according to claim 2 wherein said lateral stabilizer is defined by a horizontal flange extending beneath said support member.

5. An illuminated snowboard track according to claim 2 wherein a plurality of transverse ground support members are spaced along the length of said upright support member.

6. An illuminated snowboard track according to claim 1 wherein said reinforcing members are of elongated tubular metal construction and said light-projecting means extends through a central cavity in said rail.

7. An illuminated snowboard track according to claim 6 wherein said reinforcing members are interconnected by one or more cross members extending through said rail.

8. An illuminated snowboard track according to claim 6 wherein said light-projecting means is neon tubing.

9. An illuminated snowboard track according to claim 1 wherein said rail has an upper flat, textured surface and said reinforcing members have upper surfaces substantially flush with said surface portions.

10. An illuminated snowboard track comprising:

an elongated hollow rail having a substantially flat upper transparent surface sufficiently slippery to be adapted for slidable advancement of a snowboard, skateboard or ski therealong;

a continuous base support member extending beneath said rail;

means for projecting light upwardly through said upper transparent surface of said rail along the substantial length thereof; and elongated rounded reinforcing members projecting from recesses continuously along opposite sides of said surface portion, said reinforcing members including exposed upper surfaces substantially flush with said upper transparent surface.

11. An illuminated snowboard track according to claim 10 wherein at least one connecting plate extends through said rail transversely of said reinforcing members.

12. An illuminated snowboard track according to claim 10 wherein said light-projecting means is defined by an elongated light-emitting element extending through said rail beneath said upper transparent surface.

13. An illuminated snowboard track according to claim 10 wherein said surface portion is composed of a transparent rigid plastic material and said reinforcing members are composed of metal.

14. An illuminated snowboard track comprising:

an elongated rail having an upper transparent surface portion for slidable advancement of a snowboard, skateboard or ski therealong, and elongated reinforcing members extending continuously along opposite sides of said surface portion for the substantial length thereof;

means for supporting said rail in spaced relation to a ground surface;

means extending longitudinally through a continuous cavity in the interior of said rail for projecting light upwardly through said transparent surface portion; and base support means for supporting said rail a predetermined distance above a ground surface including support posts at spaced intervals therealong.

15. An illuminated snowboard track according to claim 14 wherein said reinforcing members are interconnected by a plurality of support brackets extending transversely of said rail.

16. An illuminated snowboard track according to claim 14 wherein said reinforcing members are of elongated tubular configuration extending the substantial length of said rail.

17. An illuminated snowboard track according to claim 14 wherein said light-projecting means is defined by a pair of elongated light-emitting elements extending in laterally spaced relation to one another through a cavity in said rail.

18. An illuminated snowboard track according to claim 17 wherein said light-emitting elements are mounted in spaced cavities to emit light upwardly along opposite sides of said rail.

19. An illuminated snowboard track according to claim 14 wherein said reinforcing members terminate in rounded U-shaped end members at opposite ends of said rail.

* * * * *